United States Patent [19]

Farkas et al.

[11] 4,177,610

[45] Dec. 11, 1979

[54] APPARATUS FOR MACHINING LARGE HEAVY WORKPIECES IN SITUS

[75] Inventors: Kalman Farkas, Dover; Gary A. Krebs, Mt. Wolf, both of Pa.

[73] Assignee: Allis-Chalmers Corporation, Milwaukee, Wis.

[21] Appl. No.: 904,766

[22] Filed: May 11, 1978

[51] Int. Cl.[2] ..... B24B 19/00

[52] U.S. Cl. ..... 51/241 S; 409/179

[58] Field of Search ..... 51/241 R, 241 B, 241 S, 51/245, 90; 90/12.5; 82/4 R, 34 R; 29/156.8R

[56] References Cited

U.S. PATENT DOCUMENTS

| | | | |
|---|---|---|---|
| 1,799,109 | 3/1931 | Lyne | 51/241 R |
| 2,412,199 | 12/1946 | Blood | 51/241 B |
| 2,455,762 | 12/1948 | Hall | 51/90 |
| 3,608,172 | 9/1971 | Lindquist | 51/241 R |
| 3,617,142 | 11/1971 | DeWane | 51/241 S |

*Primary Examiner*—Harold D. Whitehead
*Assistant Examiner*—Roscoe V. Parker
*Attorney, Agent, or Firm*—Robert C. Jones

[57] ABSTRACT

Apparatus for machining an extremely large and very heavy workpiece, such as a runner of a hydro-turbine machine, in situs. The hub of the hydro-turbine runner is utilized as a support for a rotatable beam which is arranged to carry a depending grinding or cutting tool in position to machine the wear ring surface of the turbine. Positioning of the grinding tool both in a vertical direction and a radial direction is effected to control the grinding operation. The power drive grinding tool is bodily rotated around the wear right by rotating the entire supporting beam around an axis which is concentric with the axis of the runner.

4 Claims, 3 Drawing Figures

APPARATUS FOR MACHINING LARGE HEAVY WORKPIECES IN SITUS

BACKGROUND OF THE INVENTION

This invention relates to an apparatus for machining or grinding a large and heavy workpiece, and more particularly to an apparatus of the aforesaid type which includes a rotatable tool support mounted for rotation on an in-place stationarily-mounted runner of a hydro-turbine machine. The apparatus includes a self-contained drive package for the tool support whereby the tool, such as a grinding wheel, may be bodily rotated to effect with the surface of the turbine wear ring while mounted on the turbine runner without being removed from the runner. The invention will be described in connection with the machining of the extremely heavy and large runner of a hydraulic turbine. Such a runner typically might have a weight of 450 tons, and a physical size such as 20 feet in diameter and a height of 12 feet.

The apparatus for machining a workpiece is particularly useful for use in machining an extremely large workpiece such as the runner of a hydraulic turbine, for example, which is too large and heavy for construction and machining in one piece at a manufacturing site which may be far distant from the site of its intended use, and which therefore requires that a plurality of pieces manufactured at the factory be fabricated into a unitary member in its operating position at the site of its intended use.

OBJECTS OF THE INVENTION

Accordingly, it is an object of the present invention to provide an apparatus for machining a large and heavy workpiece in accordance with which the workpiece to be machined is stationarily mounted in its operating position and a machining tool is mounted on the workpiece for rotational movement about the circumference of the workpiece.

It is another object of the invention to provide an apparatus for machining a large and heavy workpiece, such as the runner of a hydraulic turbine, in which the workpiece is stationarily supported while being machined, and in which the machining tool may be supported for rotation on the runner for effecting the machining operation.

The apparatus includes a vertical center support column on the upper end of which is mounted a rotatable tool support beam. The workpiece, such as a turbine runner, which is to be machined is suitably secured and a machining tool is suitably supported by the beam for bodily movement relative to the workpiece around the circumference thereof.

Further objects and advantages of the invention will become apparent from the following description taken in conjunction with the accompanying drawings in which:

DESCRIPTION OF THE INVENTION

Figure 1:
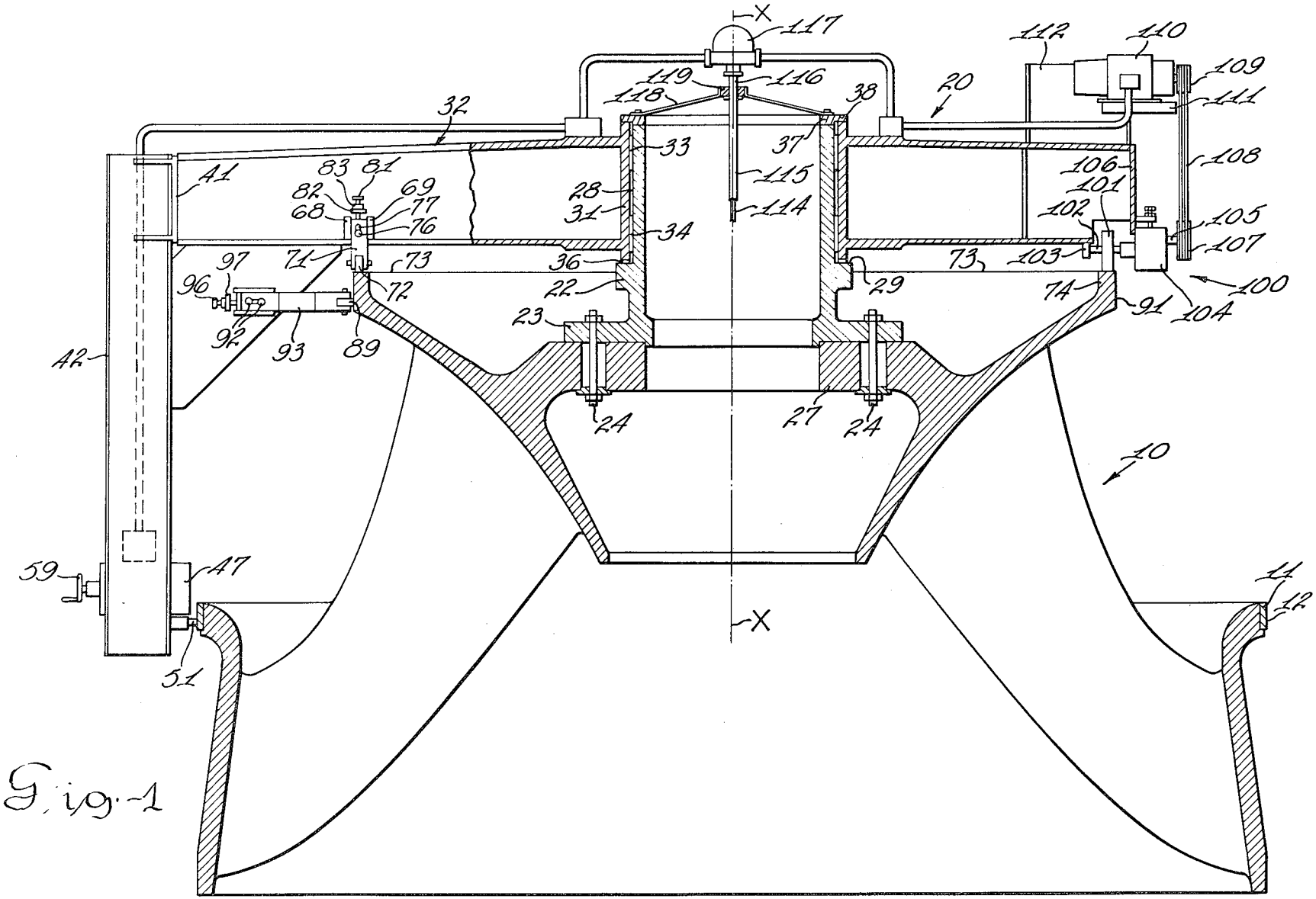
FIG. 1 is a view partly in elevation and partly in vertical section showing the general arrangement of the machining apparatus, including the center column on which the rotatable beam support is mounted and showing the beam drive arrangement for effecting the bodily rotation of the machining tool about the circumference of the wear ring of the hydro-turbine machine; and, FIG. 2 is a top plan view of the apparatus of FIG. 1.

Referring now to the drawings, there is shown a turbine runner 10 secured to a fixed support (not shown) at the site of intended use. The runner 10 includes a circumferential first portion which is adapted to carry a wear ring 11, the outer surface of which must be finished to a desired tolerance. The runner 10 is extremely heavy, having a weight of approximately 236,300 pounds and a diameter of 20 feet, with its height being approximately 12 feet. This very large sized runner poses handling and shipping problems. To avoid such problems, the runner is manufactured in two pieces and shipped to the sites situs of intended use in this form. Once on site, the runner is welded together and bolted to form a unitized structure. The wear ring 11 which is shipped in four equal sections is bolted in position on the runner 10 and the heads of the bolts twisted off by suitable wrench means. The field assembly results in dimensional tolerance in the O.D. of the runner wear ring 11 which is not acceptable in the completely assembled turbine machine, that is the spacing between the outer circumferential surface 12 of the runner wear ring 11 and the inner circumferential surface 14 of a discharge wear ring 16 of an associated discharge ring 17, shown in FIG. 3, must be on the order of approximately 150 thousandths of an inch minimum. Since the discharge ring 17 is a part of the large draft tube of the turbine, it is not practical to attempt to machine the discharge wear ring 16 in the field, the assembled wear ring 11 of the runner 10 must be machined to provide the necessary dimensional characteristic. To effect the machining of the runner wear ring 11, there is provided a machining device 20 which is particularly well suited to provide the required operation.

As shown, the machining device 20 includes a central hub 22 having a lower radial flange 23. A plurality of bolts 24 extend through suitable openings in an internal inwardly extending flange or collar 27 of the runner 10 and pass through suitable openings in the flange 23 of the hub 22 to secure the hub on the runner 10, the arrangement being such that the vertical axis of the hub 22 is coaxial with the axis of the runner 10. The hub 22 is provided with a circumferential reduced portion 28 which forms an outwardly extending radial shoulder or seat 29. Mounted on the reduced portion 28 of the hub 22 is a hub 31 of a tool support beam 32. The tool support beam 32 is adapted to be rotated relative to the stationary hub 22 and to this end there is provided bearings 33 and 34 which constitute the main bearing and a thrust bearing 36. A cap plate 37 is secured to the top or upper end surface of the hub 22 and is provided with a radially outwardly extending flange 38. The flange 38 is dimensioned so as to overlay the axial end of the beam hub 31 and serves to maintain the beam hub 31 in engagement with the thrust bearing 36. Thus, the radial bearings 33 and 34 provides the required rigidity for the rotating beam while the thrust bearing 36 provides the antifriction support for the beam.

Figures 2, 3:
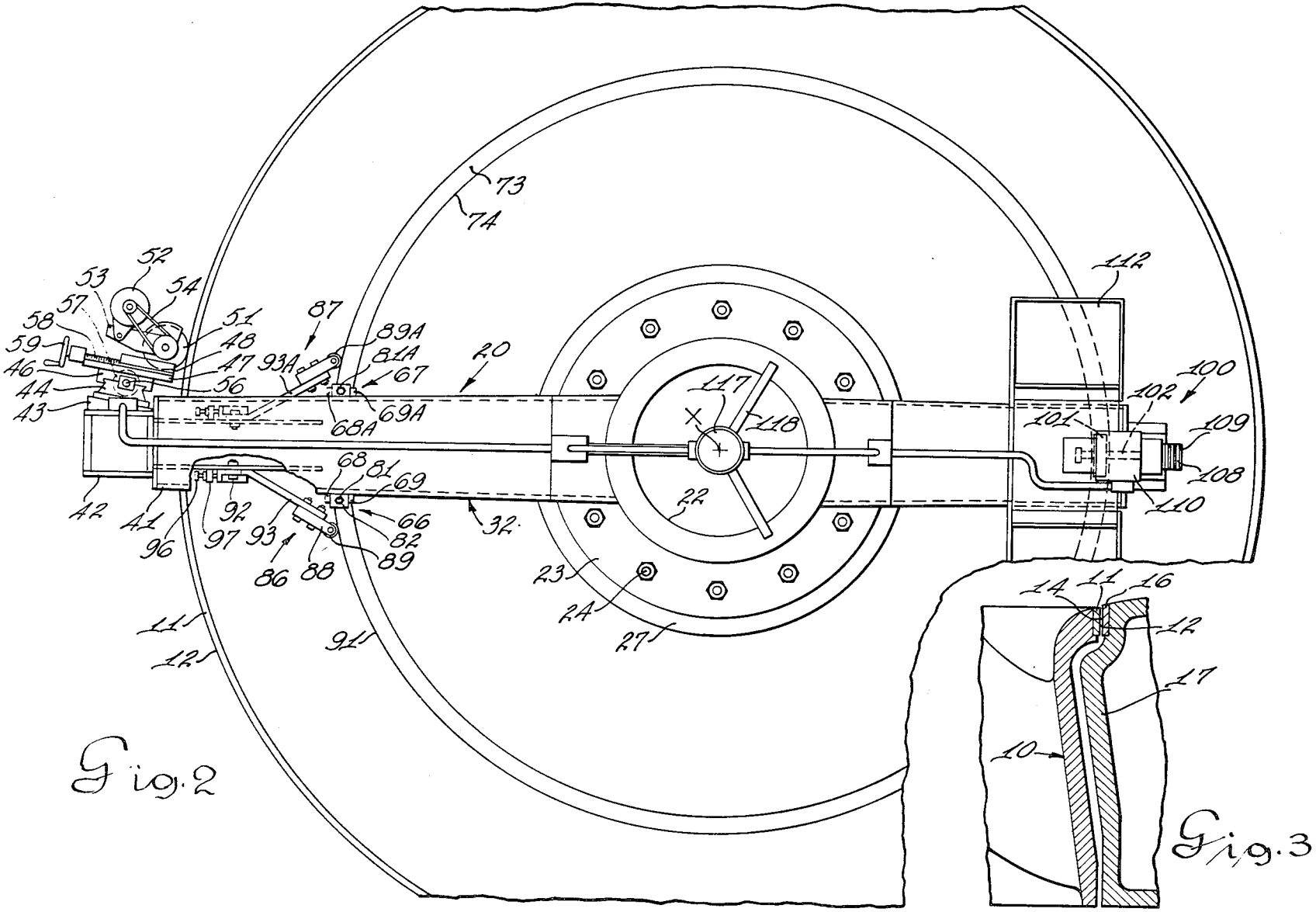
FIG. 3 is a partial cross-sectional view of an assembled turbine machine showing the spacing between the inner wear ring and an associated discharge ring.

The beam 32 is a fabricated box girder, the outer one end 41 thereof receiving a depending fabricated box column 42. At the lower end of the box column 42 and at the one side thereof, as best shown in FIG. 2, there is provided a slanted carrier plate 43 to which a vertical guide plate 44 is secured. A vertically movable slide 46 is mounted in dovetail relationship on the guide plate 44. Secured to the face of the slide 46 is a cross slide guide way 47 which slidably receives a tool cross slide 48. As shown, the tool cross slide 48 mounts a tool 51 herein is depicted as a grinding wheel. An electric motor 52 is carried on the cross slide 48 by means of a bracket 53 which also supports the grinding wheel assembly. A belt 54 transmits the power from the electric motor 52 to the grinding wheel. Vertical positioning movement of the grinding wheel 51 is accomplished by means of a screw 56 in cooperation with a nut (not shown) arrangement in a well known manner. Actuation of the screw and nut drive 56 is effected by means of a hand wheel 57 attached to the lower depending end of the screw. Movement of the grinding wheel 51 into and out of engagement with the wear ring 11 to establish the depth of cut or material to be removed is effected by means of a screw 58 and a cooperating anti-friction nut (not shown) in a well known manner. Rotation of the screw 58 is effected by rotation of a hand wheel 59.

Support for the beam 32 to maintain and stabilize it in a horizontal plane relative to the axis of the runner is accomplished by a pair of roller supports 66 and 67. Each of the roller supports are identical. Thus, the description for the support 66 will also apply to the support 67, similar parts being identified by the same reference number with the reference number associated with the support 67 having letter suffixes. As shown in the Figs., the support 66 includes a pair of spaced apart guide brackets 68 and 69. Between the brackets 68 and 69 there is supported a roller body 71, the lower end of which is provided with rotatable roller 72. The roller body 71 is supported between the brackets 68 and 69 for vertical positioning movement and is adjusted so as to maintain the associated roller 72 in engagement with a top surface 73 of a circular second portion or runner crown 74. With the roller 72 in adjusted position relative to the runner crown surface 73, a nut associated with a bolt 76 is tightened to lock the roller body 71 in position. The bolt 76 is welded to the side of the beam support 32 and extends outwardly through an elongated vertical slot 77 formed in the roller body 71. To lock the roller body 71 in its adjusted position, a bolt 81 threadedly engaged in an outwardly extending bracket 82 is tightened against the upper end of the roller body 71 and locked in the position by a lock nut 83. Preloading of the main bearings 33 and 34 is provided by operation of a pair of horizontal roller stabilizers 86 and 87. The stabilizers 86 and 87 are similar and like parts will be identified by the same reference number. However, a letter suffix is added to the numbers associated with the stabilizer 87. As shown, the stabilizer 86 includes a roller body 88 which carries a roller 89 that is positionable against the circumferential surface 91 of the runner crown 74. Positioning of the roller 89 is effected by releasing bolts 92 and manually moving the roller body bracket 93 to effect the desired engagement of the roller 89 with the runner crown side surface 91. With the roller 91 in engagement with the surface 91, the bolts 92 are tightened to secure the bracket in position. A locking bolt 96 threaded in an outwardly extending bracket 97 is engaged against the end of the bracket 93 to lock it in adjusted position.

As is shown in FIG. 2, the brackets 93 and 93A are bent outwardly away from the tool support beam 32 and operate to apply a spring force to the rollers 89 and 89A, respectively. Thus, the spring effect of the brackets is applied to the circumferential side surface of the second portion of the workpiece as the beam is rotated and thereby preloads the main bearings 33 and 34 substantially in a plane in which the metal removing operation is being effected. Thus, at any point in time the bearings are preloaded with respect to the metal removing operation.

For rotating the tool 51 around the circumferential surface 12 of the runner wear ring 11, there is provided a power drive means 100. The drive means 100 is operable to effect the rotational movement of the tool supporting beam 32 about the axis X—X, thereby moving the tool 51 and its associated drive motor 52 bodily around the wear ring circumference. As the tool 52 is moved bodily, it is also rotated to effect a metal removing operation on the surface 12 of the wear ring 11. To this end, there is provided a drive wheel 101 carried on a horizontal shaft 102, one end thereof being rotatably supported in an outboard bearing bracket 103. The inner end of the drive shaft 102 is supported in a bearing carried by a gear reducer unit 104. A bracket 106 welded or otherwise secured to the end of the beam 32 receives the gear reducer unit 104 to support it in operative position. A power input shaft 105 of the reducer unit 104 is provided with a drive sheave 107. A belt transmission 108 connected between the sheave 107 and an output sheave 109 of a variable speed electric motor 110 serves to effect power drive input to the gear reducer 104 for driving the drive wheel 101 at a desired speed. The electric motor 110 is carried on a bracket 111 which is a part of a counterweight unit 112 which aids in balancing the support beam 32.

The drive wheel 101 is arranged to engage the surface 73 of the runner crown 74. On the opposite end of the support beam, the support rollers 66 and 67 engage the crown surface 73 to prevent deflection of the support beam 32.

Power for the various electrical components is obtained from a source such as a control panel (not shown) located adjacent the machine. Such power is supplied through the center of the runner 10 via conductors 114 enclosed in a conduit 115. The conductors 114 extend through a suitable hollow mounting pipe 116 which supports an electric distribution slip-ring device 117 carried on the top or outer end of the mounting pipe 116. To provide a suitable support for the slip-ring arrangement, there is provided a spider 118 having a central hub 119, FIG. 1. The hub 119 is provided with a threaded axial bore which receives the mounting pipe 116.

Power from the slip-ring device 117 is distributed to the various electrical components via suitable conductors enclosed within protective conduits as is shown.

The embodiments of the invention in which an exclusive property or privilege is claimed are defined as follows:

1. An apparatus for removing material from a metallic workpiece in which the workpiece is utilized as the support for the apparatus, said workpiece having an axial bore and provided with a circular first portion and a circular second portion having an axial end surface and a circumferential side edge;

a bearing shaft having an axial bore secured to the workpiece with its axis coinciding with the axis of the workpiece;

a tool support beam having a hub from which first and second ends of said beam extend in opposite directions, said hub being provided with an axial bore which is adapted to be received by said bearing shaft in coaxial relationship;

a tool column secured to the said first extending end of said tool beam in depending relationship;

tool positioning means carried by the depending end of said tool column, said positioning means being movable in at least two mutually transverse paths of travel;

tool means carried by said tool positioning means for engagement with a portion of the workpiece from which metal is to be removed;

power drive means including a driving wheel carried on the second end of said tool support beam in position to engage on the axial end surface of the second portion of said workpiece to effect rotation of said tool support beam and thereby bodily movement of said tool means to effect the desired metal removing operation by said tool means on said workpiece;

an electric motor operably carried by said tool support beam; and, transmission drive means interconnecting said electric motor and said drive wheel to effect rotation of said drive wheel for rotating said tool support beam.

2. An apparatus according to claim 1 wherein said bearing shaft is provided with an antifriction radial main bearing and an antifriction thrust bearing on which said tool support beam is mounted for rotation; and, a circular plate secured to the axial end face of said bearing shaft and in engagement with the axial end face of said tool support beam hub for maintaining said beam support in engagement with said thrust bearing.

3. An apparatus according to claim 2 wherein there is provided a pair of vertical support rollers carried by the first end of said tool support beam in position to be in engagement with the axial end surface of the second portion of the workpiece to provide support for the first end of said tool support beam as it rotated by said power drive wheel; and, a pair of horizontal preload bearing rollers carried by said tool support beam in position to engage with the circumferential side edge of the second portion of the workpiece to preload said main bearing.

4. An apparatus according to claim 3 wherein said each of said horizontal preload bearing rollers are carried on the end of an associated bracket member, each of said brackets being inclined outwardly away from said tool support beam from opposite sides of said beam and operate to apply a spring load to the circumferential surface of the second portion of the workpiece to stabilize the beam and preload said said main bearings.

* * * * *